US010510228B2

(12) United States Patent
Baker et al.

(10) Patent No.: US 10,510,228 B2
(45) **Date of Patent: *Dec. 17, 2019**

(54) SECURITY SYSTEM WITH KILL SWITCH FUNCTIONALITY

(71) Applicant: InVue Security Products Inc., Charlotte, NC (US)

(72) Inventors: Kyle Baker, Waxhaw, NC (US); Jeffrey A. Grant, Charlotte, NC (US); Christopher J. Fawcett, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/000,326

(22) Filed: Jun. 5, 2018

(65) Prior Publication Data

US 2018/0286195 A1 Oct. 4, 2018

Related U.S. Application Data

(63) Continuation of application No. 15/325,849, filed as application No. PCT/US2015/040496 on Jul. 15, 2015, now Pat. No. 10,002,506.

(Continued)

(51) Int. Cl.
*G08B 13/14* (2006.01)
*G08B 13/24* (2006.01)

(Continued)

(52) U.S. Cl.
CPC ..... *G08B 13/1445* (2013.01); *G08B 13/2402* (2013.01); *G08B 25/008* (2013.01); *G08B 25/10* (2013.01)

(58) Field of Classification Search
CPC ..... G08B 13/1445; G08B 13/2402; G08B 25/008; G08B 25/10

(Continued)

(56) References Cited

U.S. PATENT DOCUMENTS 7,204,425 B2 * 4/2007 Mosher, Jr. ..... G06K 19/04 235/492
7,710,266 B2 5/2010 Belden, Jr. et al.

(Continued)

FOREIGN PATENT DOCUMENTS

WO 2014/134718 A1 9/2014

OTHER PUBLICATIONS

Extended European Search Report from corresponding European Patent Application No. 15822645.6, dated Jul. 2, 2018 (9 pages).

(Continued)

*Primary Examiner* — John A Tweel, Jr.
(74) *Attorney, Agent, or Firm* — InVue Security Products Inc.

(57) ABSTRACT

A merchandise display security system for displaying and protecting an article of merchandise is provided. In one example, the system includes a sensor configured to be coupled to an article of merchandise and to communicate with the article of merchandise. The system also includes a tower configured to receive a signal from the sensor in response to a security event. The tower is further configured to generate a kill switch signal for determining whether to activate a kill switch on the article of merchandise.

18 Claims, 6 Drawing Sheets

Related U.S. Application Data

(60) Provisional application No. 62/025,056, filed on Jul. 16, 2014.

(51) Int. Cl.
*G08B 25/00* (2006.01)
*G08B 25/10* (2006.01)

(58) Field of Classification Search
USPC ..... 340/568.3
See application file for complete search history.

(56) References Cited

U.S. PATENT DOCUMENTS

| | | | | |
|---|---|---|---|---|
| 8,514,078 | B2 | 8/2013 | Lax et al. | |
| 8,878,673 | B2 | 11/2014 | Grant et al. | |
| 10,002,506 | B2 * | 6/2018 | Baker | G08B 13/1445 |
| 2005/0116826 | A1 * | 6/2005 | Wertsebrger | G06K 19/0723 340/572.3 |
| 2007/0018843 | A1 | 1/2007 | Cullum | |
| 2009/0079566 | A1 | 3/2009 | Goldstein et al. | |
| 2011/0241870 | A1 | 10/2011 | Irmscher et al. | |
| 2012/0099256 | A1 | 4/2012 | Fawcett et al. | |
| 2012/0280810 | A1 | 11/2012 | Wheeler | |
| 2012/0293330 | A1 | 11/2012 | Grant et al. | |
| 2013/0257616 | A1 | 10/2013 | Taylor et al. | |
| 2017/0148288 | A1 | 5/2017 | Baker et al. | |

OTHER PUBLICATIONS

International Search Report and Written Opinion from corresponding International Application No. PCT/US2015/040496 dated Sep. 30, 2015 (8 pages).

<http://www.ctia.org/resource-library/press-releases/archive/ctia-announce-smartphone-anti-theft-voluntary-commitment>; "CTIA and Participating Wireless Companies Announce the "Smartphone Anti-Theft Voluntary Commitment""; dated Apr. 15, 2014 (5 pages).

* cited by examiner

SECURITY SYSTEM WITH KILL SWITCH FUNCTIONALITY

CROSS REFERENCE TO RELATED APPLICATIONS

This application is a continuation of U.S. application Ser. No. 15/325,849, filed Jan. 12, 2017, which is a 371 National Stage Entry of International Application No. PCT/US2015/040496, filed Jul. 15, 2015, which claims the benefit to priority of U.S. Provisional Patent Application No. 62/025,056 filed on Jul. 16, 2014, the entire disclosures of which are incorporated herein by reference.

FIELD OF THE INVENTION

Embodiments of the present invention relate generally to merchandise display security systems for displaying and protecting an article of merchandise from theft.

BACKGROUND OF THE INVENTION

Retailers routinely display handheld electronic merchandise, such as mobile (e.g. cellular) telephones, gaming consoles, personal data assistants (PDAs), global positioning system (GPS) devices, e-readers, tablets, media players, digital video recorders (DVRs), cameras and the like, for customers to examine before making a purchase. In some instances, the retailer desires the handheld electronic merchandise to be provided with electrical power so that a potential purchaser can evaluate the operation and features of the merchandise as well. At the same time, the retailer does not want the article of merchandise being displayed to be stolen or removed from the display by an unauthorized person. Accordingly, the article of merchandise is attached to a merchandise display security device that protects the article of merchandise from theft and unauthorized removal from the display.

BRIEF SUMMARY

Embodiments of the present invention are directed to merchandise display security systems and methods for protecting an article of merchandise from theft. In one embodiment, a merchandise display security system includes a sensor configured to be coupled to an article of merchandise, wherein the sensor is configured to communicate with the article of merchandise. The system also includes a tower configured to receive a signal from the sensor in response to a security event, wherein the tower is further configured to generate a kill switch signal for determining whether to activate a kill switch on the article of merchandise.

In another embodiment, a merchandise display security system includes an article of merchandise comprising a kill switch and a sensor configured to be coupled to the article of merchandise. The system further includes a tower configured to receive a signal from the sensor in response to a security event for activating the kill switch.

In one embodiment, a method includes providing a sensor coupled to an article of merchandise, the article of merchandise comprising a kill switch, and transmitting a signal from the sensor to a tower in response to a security event for activating the kill switch.

DETAILED DESCRIPTION OF EMBODIMENTS OF THE INVENTION

Figure 1:
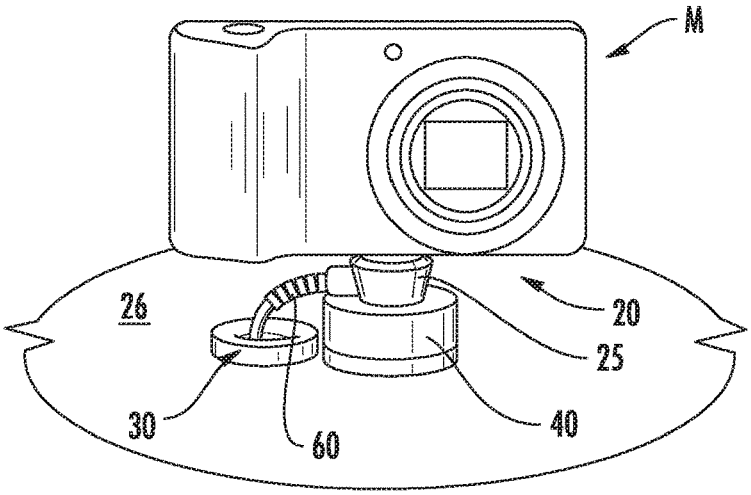
FIG. 1 is a front perspective view of a merchandise display security system according to one embodiment of the present invention.

Embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Referring now to the accompanying drawing figures wherein like reference numerals denote like elements throughout the various views, one or more exemplary embodiments of a merchandise display security system for displaying and protecting an article of merchandise are shown. More particularly, each embodiment is a merchandise display security device, indicated generally by reference character 20, for monitoring whether an article of merchandise, indicated generally by reference character M, is attached to the security device. As shown and described herein, the merchandise display security device 20 may include electronics for monitoring a sensor attached to the article of merchandise M and for activating an alarm in the event that the article of merchandise is separated (e.g., detached) from the sensor. If desired, a merchandise display security device 20 according to an embodiment of the invention may also provide electrical power to the article of merchandise M so that a potential purchaser may evaluate the merchandise in a powered state without relying solely on power provided by the internal battery of the merchandise. Thus, the security device may be applicable to any merchandise display stand, module, pedestal or the like that permits a potential purchaser to examine an article of merchandise in an unpowered state or to operate an article of merchandise in a powered state.

FIG. 1 shows an embodiment of a merchandise display security device 20 for displaying and protecting an article of merchandise M from theft or unauthorized removal from a display or other support surface 26, for example a tabletop, counter, shelf or the like, located in a retail store. The article of merchandise M is typically a display model or sample of handheld electronic merchandise, such as a mobile (e.g. cellular) telephone, smart phones, gaming console, personal data assistant (PDA), global positioning system (GPS) device, e-reader, tablet, media player, digital video recorder (DVR), handheld camera and the like, for customers to examine. The article of merchandise M is attached to the merchandise display security device 20 and may be displayed in a powered state so that potential purchasers are able to evaluate the operation and features of the merchandise when making a decision whether to purchase the item.

Figure 3:
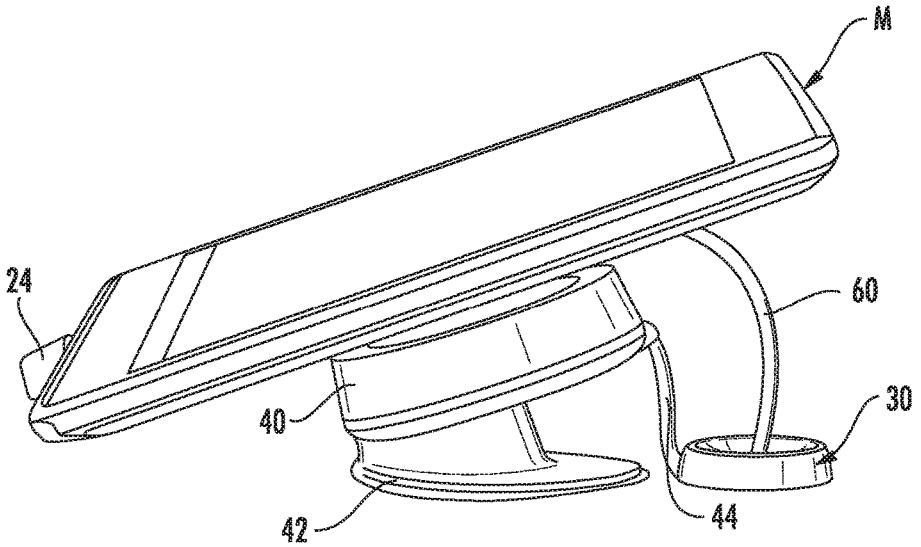
FIG. 3 is a side perspective view of a merchandise display security system according to another embodiment of the present invention.
Figure 4:
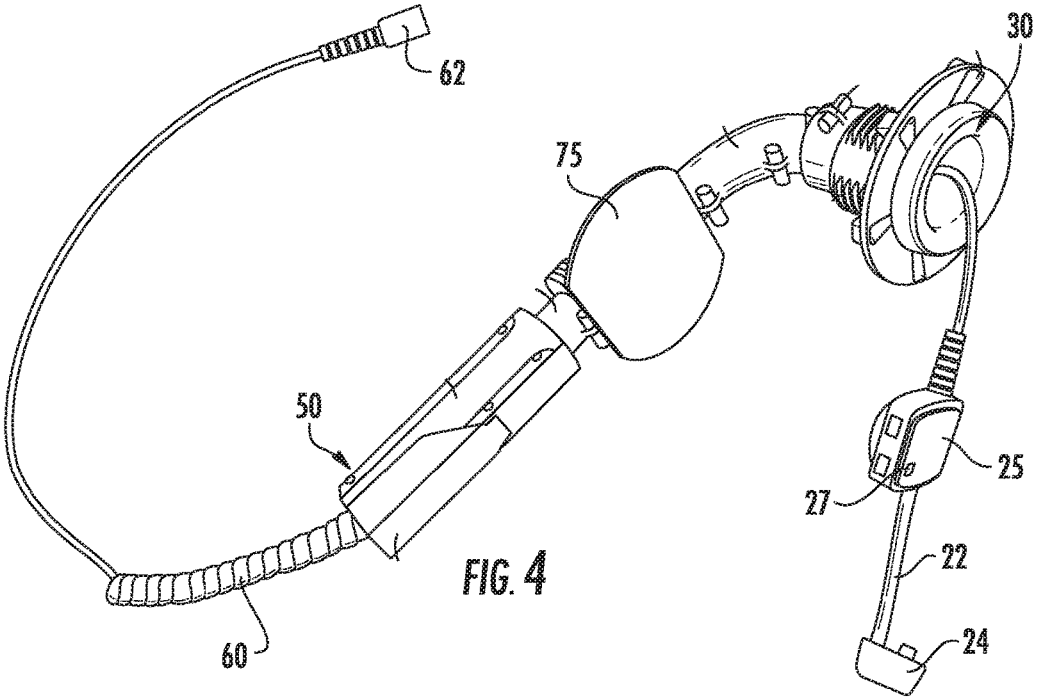
FIG. 4 is a perspective view of a cable collection tube and a sensor according to one embodiment of the present invention.

In some embodiments, the merchandise display security device 20 includes an optional power adapter cord 22 to provide electrical power to the article of merchandise M while the merchandise is on display (see, e.g., FIG. 4). The power adapter cord 22 has a connector plug 24 at one end configured to be received within a complementary connector jack at the power input port of the article of merchandise. In the illustrated embodiments shown in FIGS. 2-3, the article of merchandise M may be a cellular type mobile telephone or tablet. The article of merchandise M may have a power input port for receiving the power adapter cord 22 for electrically connecting to an external power source, for example, an AC/DC transformer commonly referred to as a "charger," electrically connected to an external power source. In addition, the article of merchandise M may be provided with an internal battery that is recharged through the power adapter cord 22 by the external power source. The power adapter cord 22 has a known type of electrical connector 24 at one end configured for electrical connection to the power input port (see, e.g., FIG. 4). In the examples illustrated herein, the power input port is a female jack configured to receive a male plug, such as a USB jack and complementary USB plug. However, embodiments of the present invention are intended to be construed broadly to include any type of standard or custom connector interface now known or hereafter devised. It is only necessary that the power adapter cord 22 has an appropriate interface at one end to electrically connect the power adapter cord to the article of merchandise M being displayed on the merchandise display security device 20.

In one embodiment, the other end of the power adapter cord 22 is "hard-wired" directly into a sensor 25 to which the article of merchandise M is attached. Alternatively, the other end of the power adapter cord may be provided with a connector interface configured for electrically connecting the power adapter cord to the sensor 25 of the merchandise display security device 20. In this manner, the power adapter cord 22 may be easily and quickly disconnected and discarded or replaced with another power adapter cord appropriate for a different type or model of handheld electronic merchandise. In another embodiment, the power adapter cord 22 and the cable 60 may be integrally formed with one another, and the power adapter cord may simply be routed through the sensor 25. In some cases, the sensor 25 may not include any electronics. In one example, the sensor may be similar to that disclosed in U.S. Patent Publication No. 2013/0241731, entitled Merchandise Security Device including Strain Relief Block, the contents of which are incorporated by reference herein.

In one embodiment, the merchandise display security device 20 comprises a mounting element 30 positioned adjacent to a base 40, the base configured for removably supporting the sensor 25 and the article of merchandise M thereon in a display orientation. In one embodiment, the mounting element 30 is coupled to a cable collection tube 50 configured to receive, contain and retain therein a cable 60 that electrically connects the sensor 25 and, consequently, the article of merchandise M, to an external power source through the power adapter cord 22. In the event it is not necessary or desired to provide electrical power to the article of merchandise M, the power adapter cord 22 may be omitted altogether. Alternatively, the merchandise display security device 20 and/or the article or merchandise M may be powered by the external power source through the power adapter cord 22.

At least a portion of the cable 60 comprises a length of an elastic or otherwise extensible electrical cable that is contained within the cable collection tube 50 and coupled to the sensor 25. As shown in FIG. 4, a portion of the cable 60 may be a helical coil cable similar to a conventional telephone handset cord comprising an outer sheath made of an insulating material surrounding a plurality of conductors for a purpose to be described hereafter. One end of the cable 60 may include a connector 62, for example, a modular (RJ) telephone plug, configured to electrically connect the conductors of the cable to an alarm module 70. The other end of the cable 60 may be "hard-wired" into the sensor 25. However, if desired, the other end of the cable 60 may comprise a connector, for example, likewise a modular (RJ) telephone plug, configured to electrically connect the conductors of the cable to electronics disposed within the sensor 25. Or, as noted above, the power adapter cord 22 and the cable 60 may be integrally formed with one another such that one or more conductors extend from the connector 62 to the connector 24, and the power adapter cord may be routed through the sensor 25.

Figure 2:
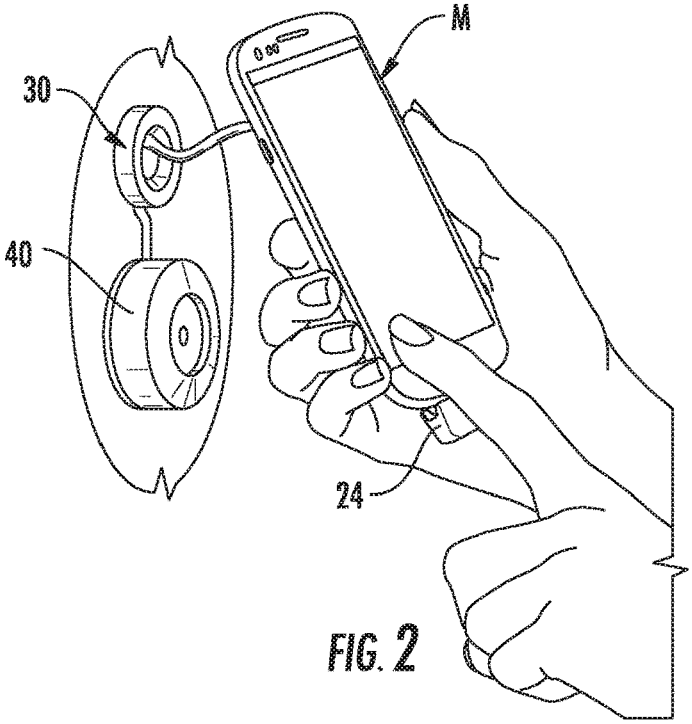
FIG. 2 is a perspective view of a merchandise display security system according to another embodiment of the present invention.
Figure 5:
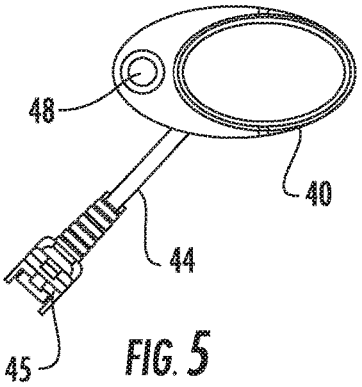
FIG. 5 is a top view of a base according to an embodiment of the present invention.
Figure 6:
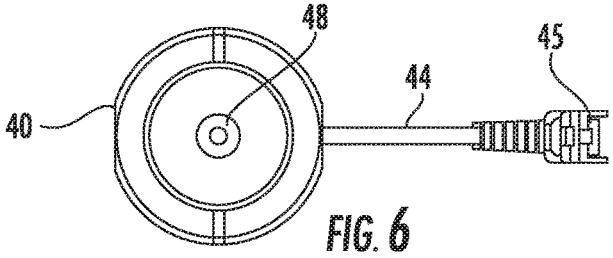
FIG. 6 is a top view of a base according to another embodiment of the present invention.

The base 40 (sometimes referred to a "puck") comprises a body that may include an upwardly extending pedestal portion or wedge 42 for removably supporting the sensor 25 and the article of merchandise M in the desired display orientation above the support surface 26 (see, e.g., FIGS. 1-3). However, it is understood that the pedestal portion could be eliminated if desired and the base 40 placed directly on the support surface 26. If desired, the base 40 and the sensor 25 may be formed with opposing geometry, or alternatively, provided with one or more magnets for aligning the sensor and the article of merchandise M in the desired display orientation. The base 40 may be any desired shape and configuration depending on the article of merchandise M to be supported. As shown, the base 40 may be configured to support a camera, a smart phone, or a tablet. For instance, FIG. 5 shows a base 40 suitable for a camera, while FIG. 6 shows a base suitable for a phone or tablet.

The merchandise display security device 20 further includes an alarm module 70. In the illustrated embodiments, the alarm module 70 is mounted below the support surface 26. In particular the alarm module 70 may be mounted directly on the cable collection tube 50 (see, e.g., FIGS. 12C-12D). The cable collection tube 50 may include an alarm support surface 75 for receiving and supporting the alarm module.

Figure 7:
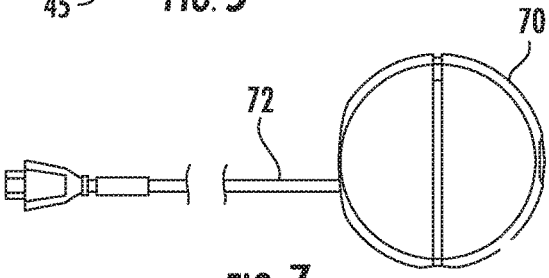
FIG. 7 is a top view of an alarm module according to an embodiment of the present invention.

As also illustrated and described above, the alarm module 70 may be electrically coupled to the cable 60. The alarm module 70 may be further coupled to a power cord for receiving power from an external power source, which as also described above, may be used to pass power to the sensor 25 and/or article of merchandise M. For instance, FIG. 7 shows that the alarm module 70 may include a cord 72 and suitable connector for electrically connecting to an external power source. Furthermore, the alarm module 70 may include circuitry for detecting a security event, such as when the sensor 25 has been removed from the article of merchandise M, the power adaptor cord is removed from the article of merchandise, and/or the cord 22 or cable 60 has been cut. The alarm module 70 may further include functionality for providing an audible and/or a visible alarm.

In one embodiment, electronics (e.g., housed within base 40 and/or alarm module 70) may be electrically connected to the sensor 25 by one or more conductors disposed within one or more cables, such as cord 22 or cable 60. As such, electronics may operate to monitor the state of a sensor switch 27, for example, a conventional proximity or limit switch, provided on the sensor 25 through cable 60 and electronics to activate an audible and/or a visible alarm in the event that the article of merchandise M is separated from the sensor. In one embodiment, the base 40 may include electronics that are electrically connected to electronics in the alarm module 70 by an electrical cable or conduit 44 comprising at least one conductor (see, e.g., FIGS. 5-6). Electrical cable 44 may be disposed on the inside or the outside of the collection tube 50. Moreover, an end of the electrical cable 44 may include a connector 45 for releasably connecting to the alarm module 70. However, in other embodiments, the sensor 25 may not include any sensor electronics and the base 40 and/or alarm module 70 may be configured to detect security events. For example, the base 40 and/or alarm module 70 may be configured to detect disconnection or cutting of cord 22 and/or cable 60.

Base 40 may further comprises a sensor switch, for example, a conventional proximity or limit switch when the base is engaged with the support surface 26. Sensor switch may be electrically connected to electronics in the alarm module 70, which operate to monitor the state of the switch and to activate an audible and/or a visible alarm in the event that base 40 is separated from the support surface 26 of the display. Base 40 may also comprise a communication port 48 for permitting communication with electronics to arm and disarm the alarm module 70 so that an authorized person can separate (e.g., detach) the article of merchandise M from the sensor 25, or separate (e.g., remove) the base from the support surface 26 of the display. For example, the communication port 48 may communicate via a wireless signal, such as via infrared communication, with a key. In some cases, the base 40 and/or the alarm module 70 may contain a security code, and the key may communicate the code to the base and/or the alarm module via the communication port 48 for arming or disarming the alarm module when the codes match. In one embodiment, the communication port 48 is accessible when the sensor is removed from the base 40, although it is understood that the communication port may be located at any desirable position on the base, or at another accessible location on the support surface 26.

Figure 8:
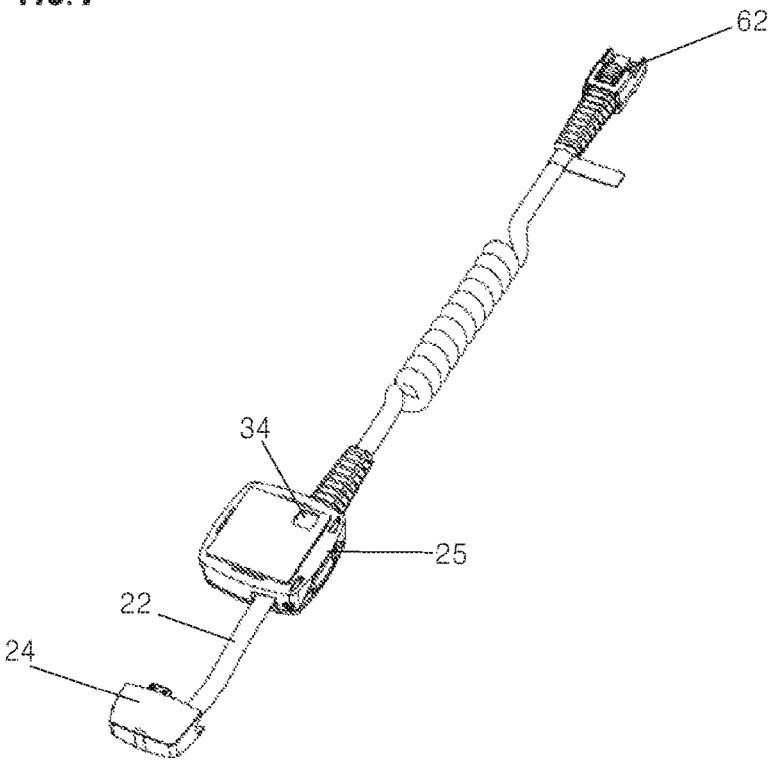
FIG. 8 is a perspective view of a sensor according to another embodiment of the present invention.
Figure 9:
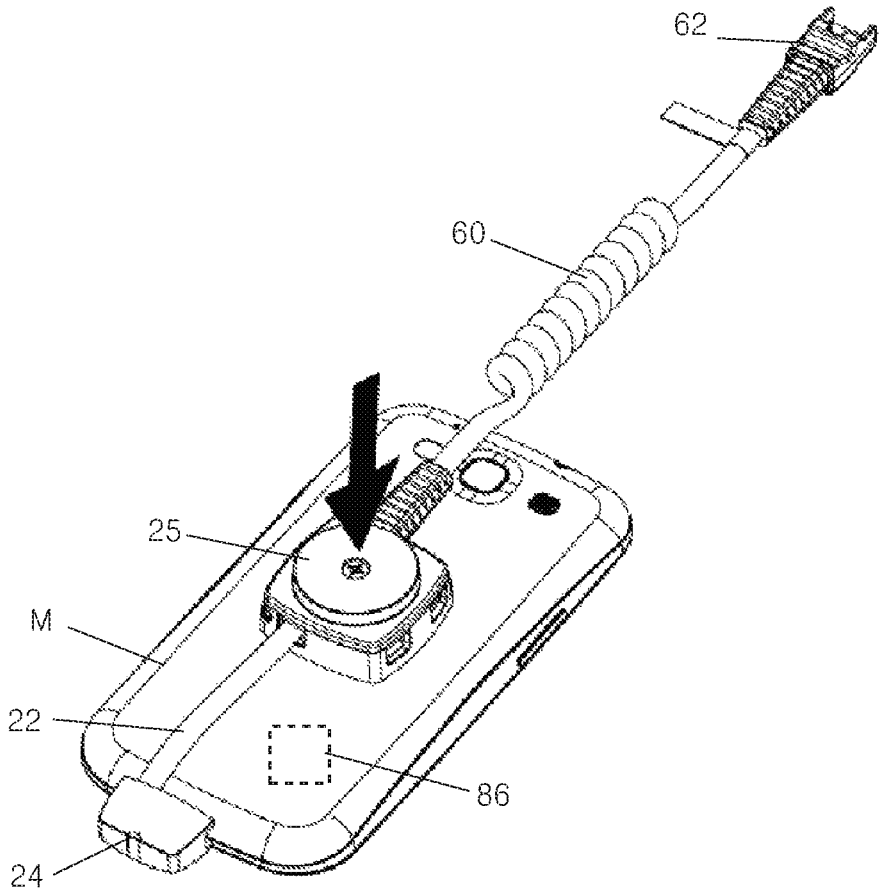
FIG. 9 is a rear perspective view of an article of merchandise and a sensor according to one embodiment of the present invention.
Figure 10:
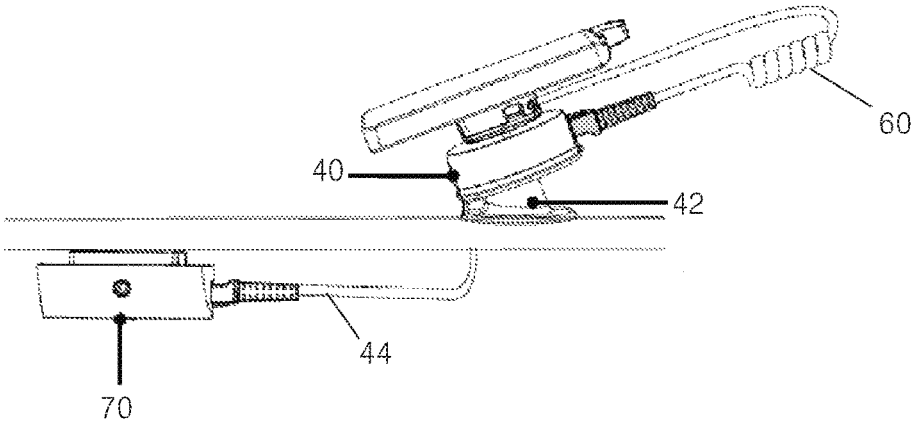
FIG. 10 is a side view of a merchandise display security system according to one embodiment of the present invention.

FIG. 10 shows another embodiment of a merchandise display security device. In this embodiment, the sensor 25 may be directly connected to the base 40 with cable 60, and the alarm unit 70 may be directly connected to the base 40 with cable 44. Thus, the cable collection tube 50 may be optional in some embodiments, and the cable 60 may be located above the support surface 26. Moreover, FIG. 9 shows an embodiment of a sensor 25 attached to an article of merchandise M, while FIG. 8 shows the sensor removed from the article of merchandise.

Figure 12A:
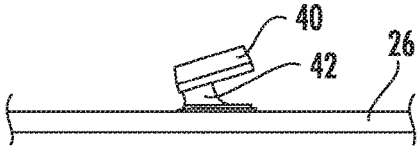
FIGS. 12A-12D illustrate various side views of a sequence of installing a merchandise display security system according to one embodiment of the present invention.
Figure 12B:
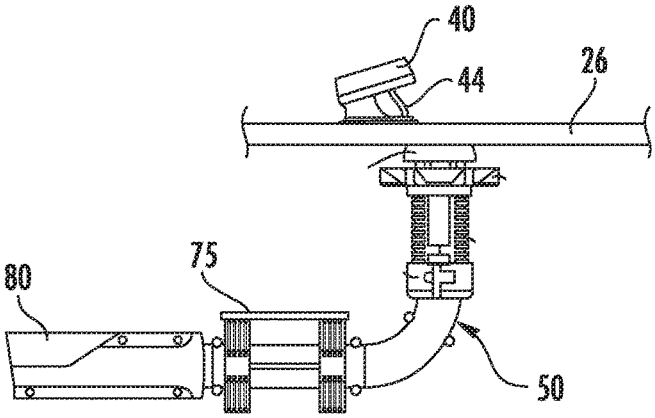
Figure 12C:
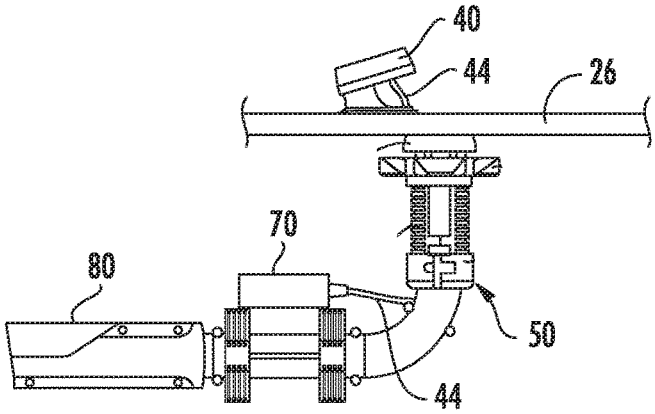
Figure 12D:
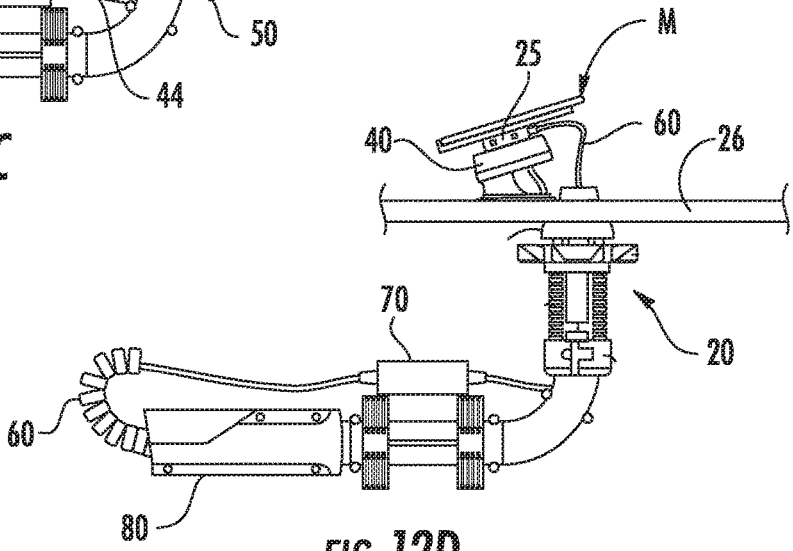

FIGS. 12A-12D illustrate various views for securing a merchandise security device 20 in position on a support surface 26 according to one embodiment of the present invention. In this regard, FIG. 12A shows that base 40 and optional pedestal 42 may be secured to the support surface 26, such as with a pressure-sensitive adhesive. FIG. 12B shows that the cable collection tube 50 may then be secured to the support surface 26. For example, a hole may be formed in the support surface 26 so that the mounting element 30 may be secured to the support surface. FIG. 12C shows that the alarm module 70 may then be mounted on the alarm support surface 75, such as with a pressure-sensitive adhesive. The cable 44 extending from the base 40 may also be routed through the support surface 26 and connected to the alarm module 70. FIG. 12D shows that the article of merchandise M may be secured to a sensor 25, such as with a pressure-sensitive adhesive, and supported on the base 40. The cable 60 connected to the sensor 25 may be routed through the cable collection tube 50. A usable length of the cable 60 may be determined and secured using the cable collection tube 50. The end of the cable 60 may then be connected to the alarm module 70. The alarm module may then be electrically connected to an external power source. In addition, the power adapter cord 22 may then be attached to the article of merchandise by inserting connector 24 into an input port on the article. It is understood that the aforementioned steps are provided as an example only, that the steps may be performed in any order, that some steps may be omitted, and that other steps may be added to perform the method.

Figure 11:
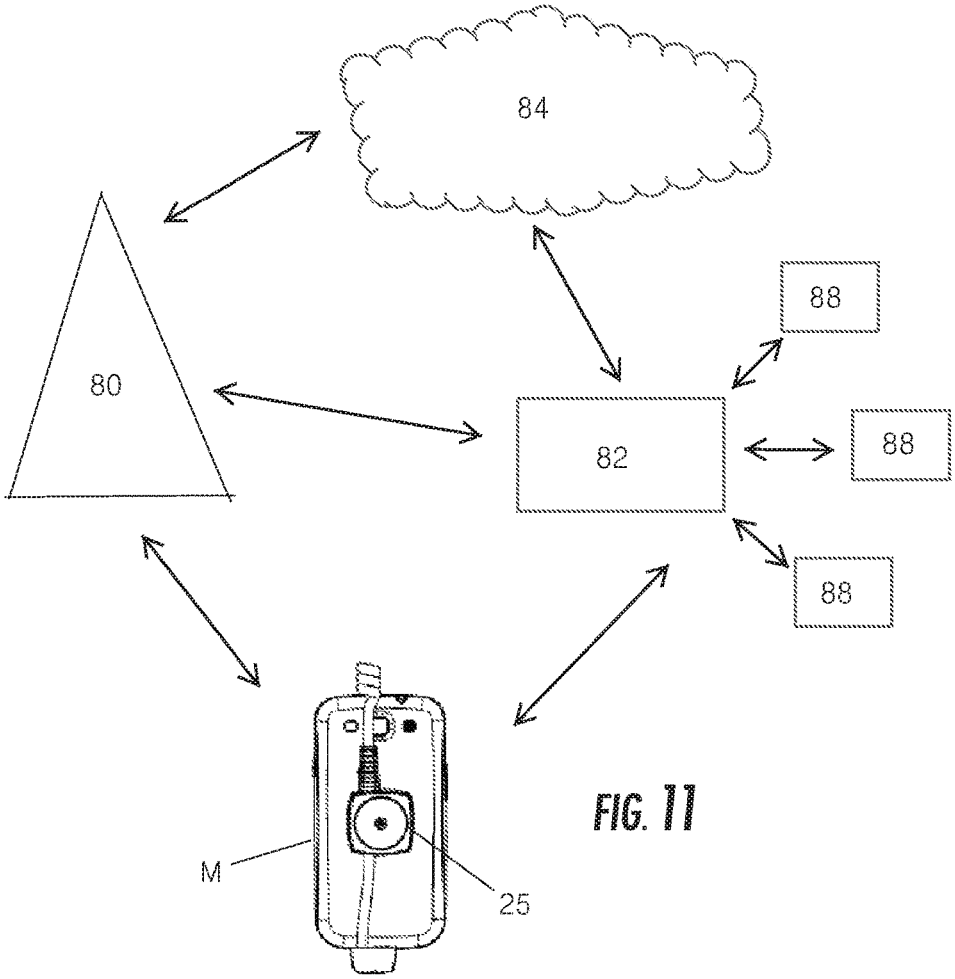
FIG. 11 is a schematic of a merchandise display security system according to an embodiment of the present invention.

Moreover in one embodiment, the sensor 25 may include wireless communication circuitry 34 for communicating with a tower 80 (see, e.g., FIG. 11). As explained in further detail below, the wireless communication circuitry 34 may be configured to wirelessly communicate with the tower 80 in response to a security event. For example, a security event may occur when the sensor 25 is removed from the article of merchandise in an unauthorized manner, or the power adapter cord 22 is removed from the article of merchandise or cut in an unauthorized manner. In some embodiments, the sensor 25 includes a switch 27 (e.g., a plunger switch) that is configured to detect when the sensor is removed from the article of merchandise in an unauthorized manner.

According to one embodiment, the sensor 25 may be configured to emit a wireless signal in response to a security event. In one embodiment, the tower 80 may include wireless communication circuitry that is configured to communicate with the wireless communication circuitry of the sensor 25. For example, the tower 80 may be configured to receive the wireless signal emitted by the sensor and to generate an alarm signal (e.g., an audible and/or a visible alarm) in response thereto. The tower 80 may also or alternatively be configured to communicate with a retailer 82 or on one or more sales associates 88 to determine whether to activate a "kill switch" associated with the article of merchandise, as explained in further detail below.

In some embodiments, the article of merchandise may include a "kill switch" 86. The kill switch may be used to disable or otherwise render the article of merchandise inoperable. In some cases, the kill switch may be embodied in software that is preloaded by the manufacturer of the article of merchandise or downloaded to the article of merchandise for performing the kill switch functionality. According to one example, the software may include the functionality outlined in the Smartphone Anti-Theft Voluntary Commitment released Apr. 15, 2014, the contents of which are hereby incorporated by reference in its entirety. As set forth in the Smartphone Anti-Theft Voluntary Commitment, the kill switch may be configured to wipe or erase data on the article of merchandise, render the article of merchandise inoperable, prevent reactivation without an authorized user's permission, reverse the inoperability if the article of merchandise is recovered by an authorized user, and restore data to the article of merchandise to the extent possible. In some embodiments, the kill switch is not a physical device but rather functionality associated with the article of merchandise, although it is understood that the article of merchandise may include a processor, printed circuit board, or circuitry configured to perform such functionality.

Therefore, the sensor 25 and tower 80 may be configured to cooperate with a retailer 82 and/or on one or more sales associates 88 to determine whether to activate a kill switch on an article of merchandise that has experienced a security event. For instance, the tower may receive a signal from the sensor indicating that a security event has occurred, and the tower may in turn communicate a kill switch signal to a retailer and/or one or more sales associates. The kill switch signal may be used to convey that a security event associated with an article of merchandise has occurred. The kill switch signal may also include various information such as a unique identifier associated with the article of merchandise experiencing the security event. The retailer and/or one or more sales associates may then determine whether to activate the kill switch on the article of merchandise. For example, upon receiving notification from the tower, a sales associate may check the article of merchandise to determine whether a security event has occurred or whether there has been a false alarm. Thus, in this instance, the sensor and tower may communicate to provide notification to the retailer and/or one or more sales associates so that the retailer and/or one or more sales associates may make the decision whether to activate the kill switch. If the kill switch is activated and the article of merchandise is subsequently recovered, the software on the article of merchandise may allow the retailer or sales associate to restore the functionality of the article of merchandise, such as by entering a password.

In other embodiments, the kill switch may be automatically activated upon the occurrence of a security event. Thus, the sensor and/or the tower could communicate directly with the article of merchandise to activate the kill switch.

In one embodiment, the sensor and the article of merchandise are configured to be paired with one another. For example, the article of merchandise may include a unique identifier (e.g., a serial number) that is communicated to the sensor, such as through the power adapter cord 22 or wireless communication circuitry. The sensor may in turn be configured to communicate the unique identifier to the tower. Thus, the sensor may be configured to determine the unique identifier of the article of merchandise so that if the kill switch is activated, the kill switch is activated on the correct article of merchandise. In other cases, the sensor and the article of merchandise may be configured to communicate with one another so that the sensor may directly activate the kill switch. Thus, the tower may be optional in some instances.

It is understood that the tower 80 may be located at any desired location, such as at an exit of retail store or in the vicinity of the article of merchandise on display. In some cases, the tower 80 may be located proximate to the article of merchandise on display, such as below a support surface 26. In addition, any number of towers 80 may be employed. For example, one tower 80 may be configured to communicate with a plurality of sensors 25. Alternatively, one tower 80 may be paired with one sensor 25. Moreover, various means of wireless communication may be utilized between the sensor 25 and the tower 80, as well as between the tower 80 and the retailer and/or sales associates. Moreover, use of the term "tower" is not intended to be limiting, as the tower 80 may be any beacon, door manager, controller, or the like that is configured to communicate with the sensor 25 and a retailer and/or one or more sales associates. In some embodiments, the tower 80 may be integrated with the base 40 or alarm unit 70.

According to one embodiment, the wireless communication circuitry 34 may include a radio transmitter that is configured to emit a signal at a frequency that is detectable by a radio receiver in the tower 80. Upon receipt of the signal, the tower 80 would communicate with a retailer and/or more or more sales associates, and may also or alternatively generate an alarm signal. Other wireless communication techniques are possible such as, for example, Bluetooth, Bluetooth low energy (BLE), near field communication, WiFi, or the like. The tower 80 may be configured to "listen" for the wireless signal emitted by the sensor 25 and notify a retailer and/or sales associate(s) upon receiving the signal. Thus, in some cases, one-way communication from the sensor 25 to the tower 80 occurs.

In one embodiment, the sensor 25 and the tower 80 are configured to be paired with one another. For example, the sensor 25 may include a unique identifier (e.g., a serial number) that is communicated to the tower 80, such as via respective wireless communication circuitry. The sensor 25 may be configured to emit a signal to the tower 80 whereby the tower recognizes the sensor's identifier. Thus, no kill switch and/or alarm signal is generated when the tower 80 is receiving the signal from the sensor 25. However, the tower 80 may be configured to detect when the signal is no longer received and to communicate with the retailer and/or sales associates and/or generate an alarm signal in response thereto. In one example, the sensor 25 and tower 80 may be paired with one another when the sensor is connected to the article of merchandise. This pairing may occur each time the sensor 25 is connected to an article of merchandise.

In another embodiment, the sensor 25 may be a tag that is configured to communicate with the tower 80 when in proximity thereto. For example, the tag may be an RFID tag that is detectable by the tower 80. Thus, should the tower 80 detect an RFID tag, the tower may communicate a kill switch signal to the retailer and/or one or more sales associates to determine whether to activate a kill switch. Alternatively, the tower 80 may be configured to communicate directly with the article of merchandise to activate the kill switch upon detecting the sensor 25. The RFID tag may be passive in some cases and may be attached to the article of merchandise or positioned within the article, such as in a battery compartment.

In some embodiments, the tower 80 may be configured to communicate with a retailer's or sales associate's laptop, tablet, or like electronic device (e.g., directly or through a cloud network). In one particular embodiment, the tower 80 is configured to communicate with one or more retailer's or sales associate's electronic devices over a network 84. For instance, the network may facilitate communication with a plurality of tablet devices used by sales associates within a retail environment. For example, the tower 80 or retailer may send a text message to one or more sales associates. Communication over the network may occur wirelessly (e.g., via radiofrequency or cellular communication). One or more gateways may be used to facilitate communication between the tower 80 and the retailer's electronic device(s). For instance, a gateway (e.g., a router) between the tower 80 and the cloud network may be configured to facilitate communication with a retailer's gateway and may be configured to allow the retailer to provide and receive data from the tower. The retailer may be able to direct various commands via the cloud network such as, for example, determining whether to activate a kill switch on an article of merchandise and/or to generate an audible and/or a visible alarm.

In other embodiments, the article of merchandise may be configured to activate the kill switch. For instance, the article of merchandise may include software that activates the kill switch in response to a security event, such as disconnecting the power adapter cord 22.

Embodiments of a merchandise display security device including at least the aforementioned features have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise display security system for protecting a handheld electronic article of merchandise from theft in a retail store, the merchandise display security system comprising:

a handheld electronic article of merchandise on display in a retail store, the handheld electronic article of merchandise comprising a software program for generating a kill switch on the handheld electronic article of merchandise in response to a security event;

wherein the handheld electronic article of merchandise is configured to wirelessly transmit a unique identifier associated with the handheld electronic article of merchandise in response to the security event.

2. The merchandise display security system of claim 1, further comprising a sensor configured to be coupled to the handheld electronic article of merchandise, the sensor further configured to detect the security event.

3. The merchandise display security system of claim 2, further comprising a tower configured to receive a signal from the sensor in response to the security event for determining whether to activate the kill switch on the handheld electronic article of merchandise.

4. The merchandise display security system of claim 3, wherein the sensor and the tower each comprises wireless communication circuitry configured to wirelessly communicate with one another.

5. The merchandise display security system of claim 3, wherein the tower is configured to generate a kill switch signal for determining whether to activate the kill switch on the handheld electronic article of merchandise in response to the security event.

6. The merchandise display security system of claim 3, wherein the tower is configured to communicate the kill switch signal to a retailer and/or one or more sales associates for determining whether to activate the kill switch.

7. The merchandise display security system of claim 2, wherein the sensor comprises a power adapter cord configured to electrically connect to the handheld electronic article of merchandise.

8. The merchandise display security system of claim 7, wherein the sensor is configured to communicate with the handheld electronic article of merchandise via the power adapter cord in order to determine the unique identifier associated with the handheld electronic article of merchandise.

9. The merchandise display security system of claim 2, wherein the security event comprises removing the sensor from the handheld electronic article of merchandise.

10. The merchandise display security system of claim 1, further comprising an alarm module configured to generate an audible and/or a visible alarm in response to the security event.

11. The merchandise display security system of claim 1, wherein the kill switch is configured to render the handheld electronic article of merchandise inoperable.

12. The merchandise display security system of claim 1, wherein the handheld electronic article of merchandise is configured to activate the kill switch in response to the security event.

13. The merchandise display security system of claim 1, wherein the kill switch is configured to prevent reactivation of the handheld electronic article of merchandise without an authorized user's permission.

14. The merchandise display security system of claim 1, further comprising a tower configured to receive a signal from the handheld electronic article of merchandise in response to the security event for determining whether to activate a kill switch on the handheld electronic article of merchandise.

15. A method for protecting a handheld electronic article of merchandise from theft in a retail store, the method comprising:

providing a handheld electronic article of merchandise, the article of merchandise comprising a software program for generating a kill switch on the handheld electronic article of merchandise;

wirelessly transmitting a unique identifier from, and associated with, the handheld electronic article of merchandise in response to a security event; and activating the kill switch in response to the security event.

16. The merchandise display security system of claim 1, wherein the kill switch is configured to cause the software program to wipe or erase data from the handheld electronic article of merchandise.

17. The merchandise display security system of claim 1, wherein the handheld electronic article of merchandise is configured to wirelessly transmit the unique identifier for determining whether to generate the kill switch.

18. The merchandise display security system of claim 1, wherein the unique identifier is a serial number of the handheld electronic article of merchandise.

* * * * *